United States Patent [19]

Pritchard

[11] 4,349,107

[45] Sep. 14, 1982

[54] METER CHART ENVELOPE

[75] Inventor: Sheldon S. Pritchard, Houston, Tex.

[73] Assignee: Champion International Corporation, Stamford, Conn.

[21] Appl. No.: 227,692

[22] Filed: Jan. 23, 1981

Related U.S. Application Data

[63] Continuation of Ser. No. 89,921, Oct. 21, 1979, abandoned, which is a continuation of Ser. No. 974,029, Dec. 28, 1978, abandoned.

[51] Int. Cl.[3] ..... B65D 85/00; B65D 85/57

[52] U.S. Cl. ..... 206/449; 206/312; 229/68 R; 229/82

[58] Field of Search ..... 229/68 R, 84, 72, 82; 206/311, 312, 313, 449

[56] References Cited

U.S. PATENT DOCUMENTS

| | | | |
|---|---|---|---|
| 1,998,989 | 4/1935 | Greve | 229/84 |
| 2,003,697 | 6/1935 | Poppe | 229/84 |
| 2,281,452 | 4/1942 | Ottinger | 229/84 |
| 2,374,005 | 4/1945 | Fisler | 229/84 |
| 2,664,896 | 1/1954 | Reinemen | 229/68 R |
| 2,917,224 | 12/1959 | Humphrey | 229/72 |
| 3,279,594 | 10/1966 | Worthington | 229/68 R |

*Primary Examiner*—Stephen P. Garbe
*Attorney, Agent, or Firm*—Evelyn M. Sommer

[57] ABSTRACT

An envelope is provided, formed from a single sheet of paper material, which is substantially rectangular in configuration permitting processing on automatic equipment. The envelope is adapted for use with generally circular charts and includes a rectangular locking flap which in cooperation with the dimensions of the envelope minimizes the chance of slippage and damage to the charts.

1 Claim, 4 Drawing Figures

METER CHART ENVELOPE

This is a continuation of application Ser. No. 89,921, filed Oct. 21, 1979, now abandoned, which is a continuation of Ser. No. 974,029, filed Dec. 28, 1978, now abandoned.

BACKGROUND OF THE INVENTION

The subject invention relates to envelopes, and specifically, to envelopes for containing circular meter charts which are typically used by utilities, oil companies and the like. The charts in questions are essentially circular graphs upon which conditions such as pressure, temperature, etc. are monitored as they change with time. In operation, the chart slowly revolves in accordance with the passage of time, and any changes in the conditions being monitored are precisely recorded by a writing instrument onto the chart. It will be appreciated that the charts contain precisely located graph lines and reference characters associated with particular lines. Thus, it is very important that the charts be kept completely flat and uncreased during transportation such that the data recorded thereon reflects the accurate state of the conditions monitored.

Typically, charts are shipped in envelopes which can generally contain on the order of up to fifty charts. With so many charts in an envelope, there is a tendency for the charts to slip relative to one another with portions of some charts becoming creased or damaged during handling. One known means of minimizing slippage of the charts is to use envelopes which are square in configuration. There is a significant shortcoming, however, associated with the use of square envelopes. Specifically, the automatic processing equipment typically used by the U.S. Post Offices, while being able to process rectangular envelopes, cannot properly process square envelopes. Thus, square envelopes must be processed by hand. As the Post Offices move more and more to automatic equipment, there is an increasing possibility that square envelopes will no longer be accepted for mailing.

Accordingly, it is an object of the subject invention to provide a rectangular, but non-square, envelope for containing circular meter charts, the envelope including means for preventing slippage of the charts contained therein.

It is another object of the subject invention to provide an envelope having the above characteristics which is simple in construction and relatively inexpensive to manufacture.

SUMMARY OF THE INVENTION

In accordance with the above recited objectives, the envelope of the subject invention is formed from a single sheet of paper material and includes front and back panels, a pair of side edges, a bottom edge, and an open top portion. The front panel includes a closure flap for sealing the envelope. The back panel includes a pair of spaced apart cut portions which are preferably triangular in configuration, and in mirror image relationship with one another. The envelope also includes a locking flap hingedly connected to the back panel and disposed between the cut portions thereof. Preferably, the locking flap is generally rectangular in configuration, and is substantially centered between the side edges of the envelope. In operation, the meter charts are inserted into the envelope, and the locking flap is folded inwardly, into the envelope so as to sandwich the charts between the back panel and the locking flap. The front closure flap is then adhered to the back panel so as to completely seal the charts within the envelope. As a result, the slippage of the charts within the envelope is minimized along with the possible attendant damage to the charts.

DETAILED DESCRIPTION OF THE PREFERRED EMBODIMENT

Figure 1:
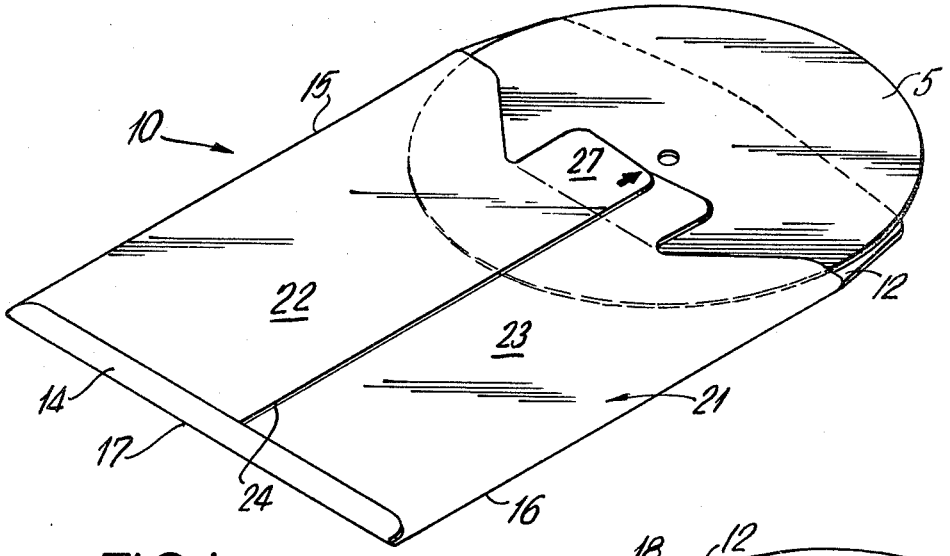
FIG. 1 is a perspective view of the envelope of the subject invention illustrating a meter chart partially inserted therein.
Figure 2:
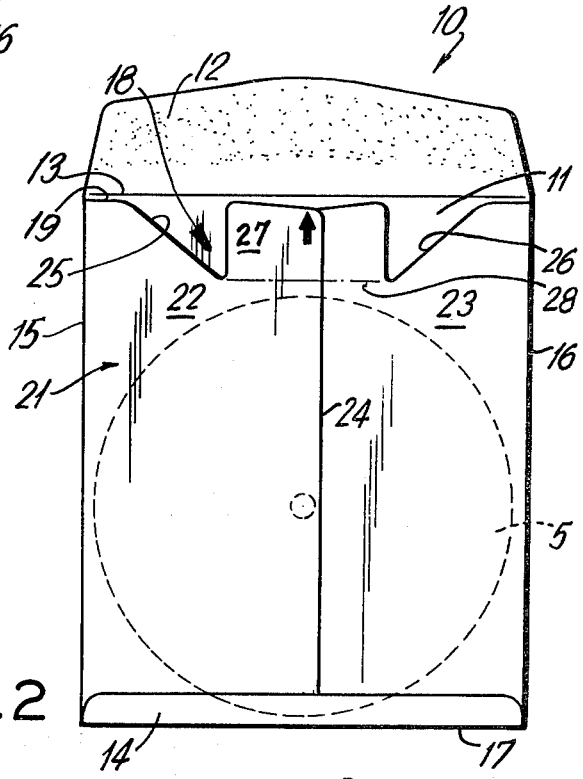
FIG. 2 is a plan view of the envelope of the subject invention illustrating the meter chart fully inserted in the envelope, and the locking flap disposed in the unlocked position.

Referring to FIGS. 1 and 2, the envelope of the subject invention is designated generally by reference numeral 10 and it includes a front panel 11, a back panel 21, having a top edge portion 19, a pair of side edges 15 and 16, which define the length of the envelope, a bottom closure flap 14 defining a closed bottom edge portion 17, (bottom edge 17 defining the width of the envelope), and an open top portion 18. In accordance with the subject invention, the envelope 10 is an elongated rectangle in configuration having a length greater than its width. A top closure flap 12 is hingedly connected to front panel 11 along fold line 13 for sealing the open portion of the envelope. As illustrated in the figures, envelope 10 may be formed from a single sheet of paper such that back panel 21 comprises a pair of overlapping portions 22 and 23, and a seam 24.

Further referring to FIGS. 1 and 2, back panel 21 includes a pair of spaced apart cut portions 25 and 26. Preferably, cuts 25 and 26 are substantially triangular in configuration, and disposed in mirror image relationship to one another. The subject envelope 10 further includes a locking flap 27 which is disposed between cuts 25 and 26 and hingedly connected to back panel 21 along fold line 28. Preferably, locking flap 27 is generally rectangular in configuration, and disposed so as to be centered between side edges 15 and 16.

In accordance with the subject invention, envelope 10 is adapted to receive a circular meter chart 5, and to lock the chart therein so as to prevent slippage and possible damage to the chart. Thus, the envelope is constructed such that its width, i.e., the distance between side edges 15 and 16, is slightly greater than the diameter of chart 5. In addition, the distance between fold line 28 and envelope bottom edge 17 is slightly greater than the diameter of chart 5. It will be noted that in both FIGS. 1 and 2 locking flap 27 is illustrated in the unlocked position.

Figure 3:
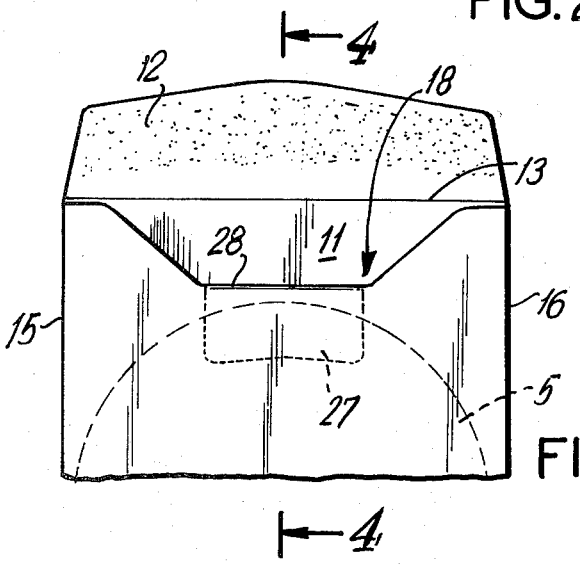
FIG. 3 is a partial plan view of the envelope of the subject invention illustrating the meter chart fully inserted in the envelope, and the locking flap disposed in the locked position.
Figure 4:
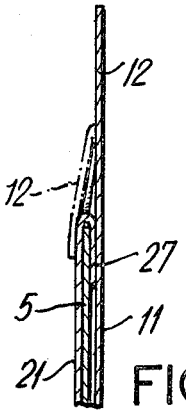
FIG. 4 is a cross sectional view of the envelope of the subject invention taken along line 4—4 of FIG. 3.

Turning now to FIGS. 3 and 4, the subject envelope 10 is shown with chart 5 fully inserted therein, and with locking flap 27 in the locked position. More particularly, as shown in FIGS. 3 and 4, locking flap 27 is inwardly folded into envelope 10 so as to overlap chart 5 and sandwich the chart between locking flap 27 and back panel 21. Top closure flap is then, of course, adhered to back panel 21 so as to completely seal the chart within the envelope.

As a result, the subject invention provides an envelope which is very simple in construction, yet very effective in reducing possible damage to the meter charts contained therein as a result of slippage. The specific construction of the envelope, including the locking flap, as well as the specific dimensions of the envelope, specifically the width thereof and the distance between locking flap fold line and the bottom edge of the envelope, effectively minimizes slippage of meter charts contained therein, even when the number of charts is on the order of fifty. In addition, the subject invention provides a substantially slip free envelope which is an elongated rectangle in configuration, rather than square as in the prior art, and thus, the subject envelope is easily processible by the automatic processing equipment used in post offices.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. An elongated rectangular envelope for containing and locking therein a circular sheet member, said envelope comprising a front panel; a back panel, said back panel including a top edge portion and a pair of spaced apart, generally triangular cut portions extending downwardly from said top edge portion, said cut portions being disposed in mirror image relationship to one another; a pair of spaced apart, opposed side edges, said side edges defining the length of the envelope; a closed bottom edge portion, said bottom edge portion defining the width of said envelope; a top cover flap hingedly connected to said front panel along a first fold line; and a generally rectangular locking flap hingedly connected to said back panel along a second fold line defining its bottom edge, opposed side edges of said locking flap being disposed between said cut portions and substantially centered between said side edges, said locking flap including a terminal top edge substantially parallel to and colinear with the top edge portion of said back panel, the width of said envelope and the distance between said second fold line and said bottom edge substantially defining a square area such that when a circular sheet member is contained within the envelope, said locking flap may be folded into the envelope such that the sheet member is sandwiched between said back panel and said locking flap so as to minimize slippage of the sheet member within the envelope.

* * * * *